United States Patent [19]

Horn

[11] 4,163,569

[45] Aug. 7, 1979

[54] SKI BRAKE

[75] Inventor: Hans Horn, Wellington, New Zealand

[73] Assignee: TMC Corporation, Baar, Switzerland

[21] Appl. No.: 883,836

[22] Filed: Mar. 6, 1978

Related U.S. Application Data

[63] Continuation of Ser. No. 720,211, Sep. 3, 1976, abandoned.

[30] Foreign Application Priority Data

Sep. 23, 1975 [AT] Austria ..... 7266/75

[51] Int. Cl.[2] ..... A63C 7/10

[52] U.S. Cl. ..... 280/605; 280/618

[58] Field of Search ..... 280/605, 604, 618; 188/5

[56] References Cited

U.S. PATENT DOCUMENTS

| | | | |
|---|---|---|---|
| 2,302,478 | 11/1942 | Snow | 280/605 |
| 3,489,424 | 1/1970 | Gertsch et al. | 280/618 |
| 3,544,123 | 12/1970 | Werner et al. | 280/636 |
| 3,989,271 | 11/1976 | Riedel | 280/605 |
| 4,033,603 | 7/1977 | Horn | 280/618 |

FOREIGN PATENT DOCUMENTS

| | | | |
|---|---|---|---|
| 2219172 | 11/1972 | Fed. Rep. of Germany | 280/605 |
| 626723 | 10/1961 | Italy | 280/605 |

*Primary Examiner*—David M. Mitchell

*Attorney, Agent, or Firm*—Blanchard, Flynn, Thiel, Boutell & Tanis

[57] ABSTRACT

A ski brake having a resilient tensioning member to which is secured bladed members is mounted on a ski plate having a releasable binding thereon. The resilient member is normally held in a position parallel to the upper surface of the sole plate by the weight of the skier to hold the bladed members in a retracted position. A release of the ski boot from the sole plate will cause the spring force of the resilient tensioning member to effect a movement of the bladed members to an extended position to brake the ski.

5 Claims, 3 Drawing Figures

SKI BRAKE

This is a continuation of application Ser. No. 720,211 filed Sept. 3, 1976 and now abandoned.

FIELD OF THE INVENTION

The invention relates to a ski brake with two shaft members which extend laterally with respect to the ski and are pivotal about an axis which extends transversely with respect to the longitudinal axis of the ski.

BACKGROUND OF THE INVENTION

Ski brakes of the abovementioned type are already known in various forms. All these known devices use differently designed springs to drive over the brake blades which effect the braking of the ski. The use of leaf springs has the disadvantage that these do not fully meet the necessary stresses, however, the use of leg springs or wire rod springs is associated with relatively high purchasing costs. In the latter the entire brake part consists thereby of high-grade and expensive spring material.

An object of the invention is to provide a simple braking device for skis which does not have the mentioned disadvantages and which can also be used in connection with so-called sole plate bindings, whereby only a limited area of the brake part consists of spring material.

SUMMARY OF THE INVENTION

The objects and purposes of the invention are met by the pivot axis for the brake members being formed of the inwardly bent shaft of each brake member which, in the retracted position of the brake blades, lie side-by-side, and by fixedly connecting with the inner ends of the two shaft members one end of a resilient tensioning lever which, in the retracted position of the brake wings, rests on the surface of the ski or a sole plate, or in a recess which is constructed in one of the aforementioned surfaces, whereby the shafts are supported or guided within a holding plate and/or in the sole plate and at least the part of the guideway or of the bearing, which part extends in the bearing surface direction of the tensioning lever, has an inclined and/or arcuate surface.

Through the inventive construction of the ski brake only the tensioning lever is made of spring wire material, so that substantial savings can be achieved in purchasing expenses. The shafts can be manufactured of low-grade, nonspring wire material, without that the quality of the brake would suffer from this.

A particularly advantageous embodiment of the invention consists in the tensioning lever having substantially a U- or V-shape, the closed end of which has approximately a circular design, which is open along the legs of the tensioning lever. This construction of the inventive ski brake results in a simple and money-saving manufacture of the resilient part, whereby the connection of the free ends of the tensioning lever or of the shafts assures a safe function.

According to a further characteristic of the invention, the incline and/or arcuate surface is designed with a sloped surface in retracting direction of the brake members, so that in the retracted position of the blade members, a smaller force is sufficient for holding the tensioning lever down than for retracting step itself. This measure has the advantage that after stepping down, the skier must not come up with any special force to hold the ski brake in the retracted position.

BRIEF DESCRIPTION OF THE DRAWING

Further advantages and details of the invention will now be described more in detail in connection with the drawings, which show one exemplary embodiment of a ski brake which is secured to a sole plate.

In the drawing.

DETAILED DESCRIPTION

Figure 2:
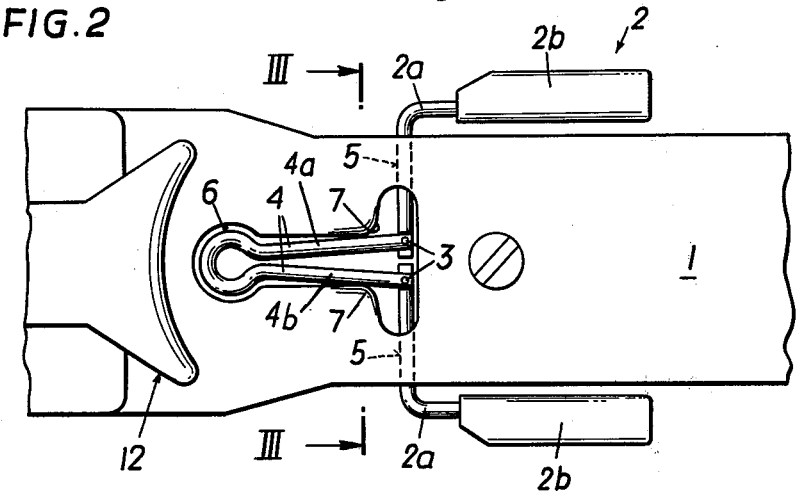
FIG. 2 is a top view.

A ski brake, which is identified as a whole with reference numeral 2, is secured in a conventional sole plate 1. The ski brake is movable between a retracted position shown in solid lines and a position of use shown in broken lines. The ski brake 2 consists of two wing-like constructed brake parts, which have as basic structure angularly bent shaft members 2*a* and brake blades 2*b* which are fixed on the shaft members. The free end of a tensioning lever 4 is secured to the free ends of each of the shaft members 2*a* by means of rivets 3 or by welding. The ends of the shaft members 2*a*, which ends are bent angularly with respect to one another, form an axis of rotation for the ski brake 2. The axis of rotation in the present example is supported in a hole 5 in a sole plate 1 which is secured to and remains with the ski. The sole plate 1 has a suitably constructed T-shaped recess 6 in which is received the tensioning lever 4 when the ski brake is in retracted condition. The area of the recess 6, which opens into the hole 5 which serves as a bearing for the axis of rotation, is enlarged in width adjacent the hole 5 through means of an inclined surface 7, so that upon stepping down on the tensioning lever 4 with the sole of a ski boot, the areas of the free ends of the tension lever 4 are guided automatically on said inclined surface 7, so that the blades 2*a* are not only pivoted about the axis of rotation, but are also pulled inwardly toward the center of the ski. The inclined surface 7 is preferably arcuate in direction of the hole 5 forming the support for the tensioning lever 4 so that the force holding the tensioning lever in position is substantialy less in the cocked position, namely after insertion of the tensioning lever 4 into the recess 6, than in the braking position. More specifically, the tensioning lever is a bifurcated member having two legs 4*a* and 4*b* (FIG. 2) which are resiliently urged outwardly from the FIG. 2 position to the broken line position illustrated in FIG. 3. The legs 4*a* and 4*b* engage the inclined or curved surfaces 7 to cause a movement of the legs toward each other when the tensioning lever is pivoted in the recess 6. The shaft members 2*a* move, therefore, laterally in response to the pivoting of the tensioning lever 6 into the recess 6.

Figure 1:
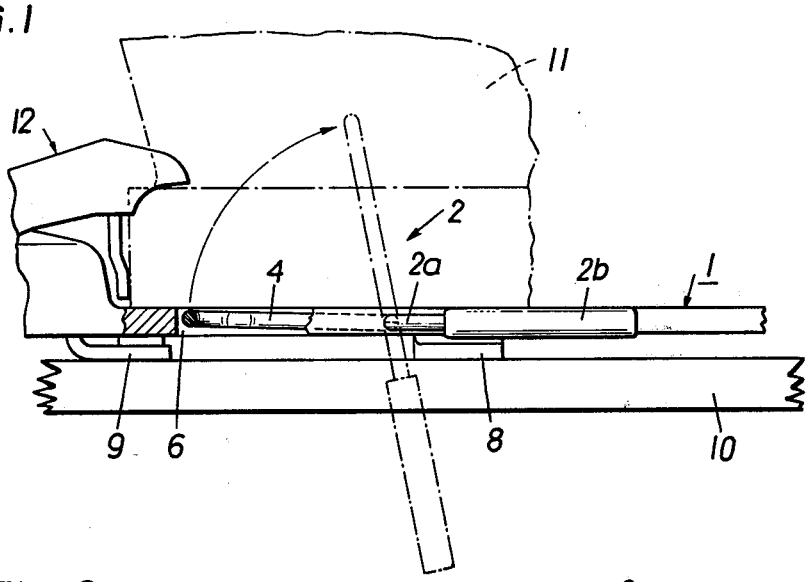
FIG. 1 is a side elevational view.
Figure 3:
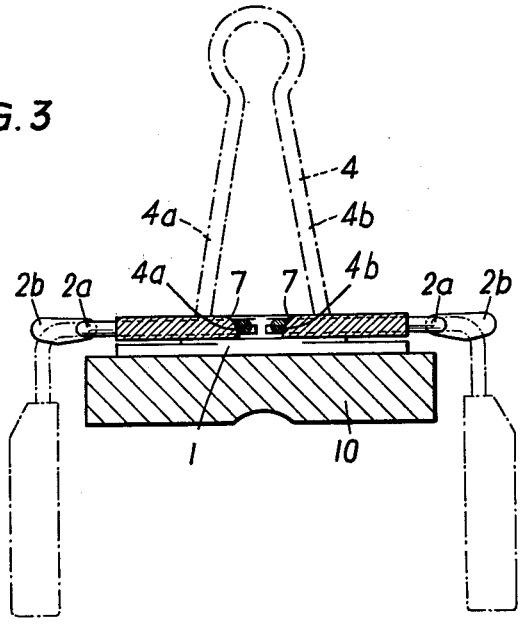
FIG. 3 is a cross-sectional view taken along the line III—III of FIG. 2, whereby FIGS. 1 and 3 also shows in dash-dotted lines the braking position or position of use of the brake blades.

Further details of the drawing are actually known and are described only for the sake of being complete. The sole plate 1 is secured to and remains with a ski 10 and engages supports 8 and 9. The heel of a ski boot 11 is indicated in FIG. 1 held to the sole plate by a heel holder 12. The ski boot is not shown in FIGS. 2 and 3. The braking position or position of use of the brake 2 is indicated by dash-dotted lines in FIGS. 1 and 3. FIG. 3 facilitates a recognition that the blades 2*b* are spaced farther away from the ski 10 in the braking position than in the cocked position illustrated in FIG. 2.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A device for braking of a ski upon release of a ski boot from a binding comprising:

a sole plate mounted on said ski and adapted to normally remain therewith, said sole plate having at least one binding thereon for releasably holding said ski boot to said sole plate;

a pair of separate and identically formed substantially rigid brake members, each of said brake members having an L-shape with one leg of the L defining a braking mandrel and the other leg defining a pivot shaft, said pair of pivot shafts extending generally horizontally and transversely to the longitudinal axis of said ski;

bearing means on said sole plate for supporting said pivot shafts for both an axial movement and a rotatable movement;

a bifurcated spring wire tensioning lever having a pair of resilient legs fixedly connected to said pivot shafts, and being pivotal therewith between a first upright position transverse to the longitudinal axis of said ski and a second position generally parallel to the longitudinal axis of said ski, said legs being flexible from a normal relaxed position inwardly toward each other and a tensioned position;

cam means on said sole plate engaging said legs of said tensioning lever while in said tensioned position for continually urging said tensioning lever from said second position toward said first position whereat said legs are in said relaxed position; and means defining a cavity in the upper surface of said sole plate wholly receiving said tensioning lever therein when in the tensioned position thereof whereby said ski boot rests directly on said sole plate.

2. A device for braking of a ski upon release of a ski boot from a binding thereon, comprising:

a sole plate mounted on said ski and adapted to normally remain therewith, said sole plate having at least one binding thereon for releasably holding said ski boot to said sole plate;

a pair of separate and identically formed substantially rigid brake members, each of said brake members having an L-shape with one leg of the L defining a braking mandrel and the other leg defining a pivot shaft, said pair of pivot shafts extending generally horizontally and transversely to the longitudinal axis of said ski;

bearing means on said sole plate for supporting said pivot shafts for both an axial movement and a rotatable movement;

a bifurcated spring wire tensioning lever having a pair of resilient legs fixedly connected to said pivot shafts, and being pivotal therewith between a first upright position transverse to the longitudinal axis of said ski and a second position generally parallel to the longitudinal axis of said ski, said legs being flexible from a normal relaxed position inwardly toward each other and a tensioned position;

a T-shaped recess on said sole plate receiving said spring wire tension lever therein, said bearing means including a pair of generally horizontally extending holes opening outwardly of said sole plate and inwardly into the cross bar portion of said T-shaped recess, said pivot shafts being received in said holes; and cam means on the walls of said T-shaped recess engaging said legs of said tensioning lever while in said tensioned position for continually urging said tensioning lever from said second position toward said first position whereat said legs are in said relaxed position whereby said tensioning lever is wholly received in said T-shaped recess when in the tensioned position thereof so that the ski boot rests directly on said sole plate.

3. The improved ski brake according to claim 2, wherein said T-shaped recess has side walls defining said cam means adjacent the intersection of the stem portion of said T-shaped recess and said cross bar portion thereof, said side walls being curved and inclined outwardly to effect a smooth transition of said tensioning lever between said first and second positions.

4. The improved ski brake according to claim 2, wherein said bifurcated tensioning lever has substantially a U- or V-shape, the closed end of which has an approximately circular shaped opening along the legs of said tensioning lever.

5. The improved ski brake according to claim 4, wherein the free ends of said legs of said tensioning lever are connected to the ends of said pivot shafts by means of rivets.

* * * * *